United States Patent [19]

Rowe

[11] 4,068,970

[45] Jan. 17, 1978

[54] CONCRETE FINISHING MACHINES

[75] Inventor: Murray A. Rowe, Canton, S. Dak.

[73] Assignee: CMI Corporation, Oklahoma City, Okla.

[21] Appl. No.: 682,522

[22] Filed: May 3, 1976

[51] Int. Cl.[2] ..... E01C 19/22

[52] U.S. Cl. ..... 404/120; 404/101

[58] Field of Search ..... 404/114, 118, 122, 119, 404/120, 106, 96, 102, 108, 101

[56] References Cited

U.S. PATENT DOCUMENTS

| | | | |
|---|---|---|---|
| 2,094,910 | 10/1937 | Baily | 404/114 X |
| 2,380,435 | 7/1945 | Heltzel | 404/102 |
| 2,449,710 | 9/1948 | Miller | 404/119 X |
| 2,510,523 | 6/1950 | Schiavi | 404/119 X |
| 2,583,108 | 1/1952 | Lewis | 404/101 |
| 2,969,720 | 1/1961 | Burnham | 404/108 X |
| 3,164,072 | 1/1965 | Blankenship | 404/96 |
| 3,450,011 | 6/1969 | Godberson | 404/122 |
| 3,528,348 | 9/1970 | Rowe | 404/120 |
| 3,593,627 | 7/1971 | Rowe | 404/119 |
| 3,738,763 | 6/1973 | Glesmann | 404/119 |

*Primary Examiner*—Nile C. Byers

*Attorney, Agent, or Firm*—Emrich, Root, O'Keeffe & Lee

[57] ABSTRACT

A concrete finishing machine embodying an elongated supporting frame for extending across a roadway, or the like, and having a conveyor screw projecting from one side of the frame for advancing and spreading concrete ahead of the machine and having screed mechanism below the supporting frame for striking-off, smoothing and vibrating such spread concrete.

9 Claims, 9 Drawing Figures

FIG. 9
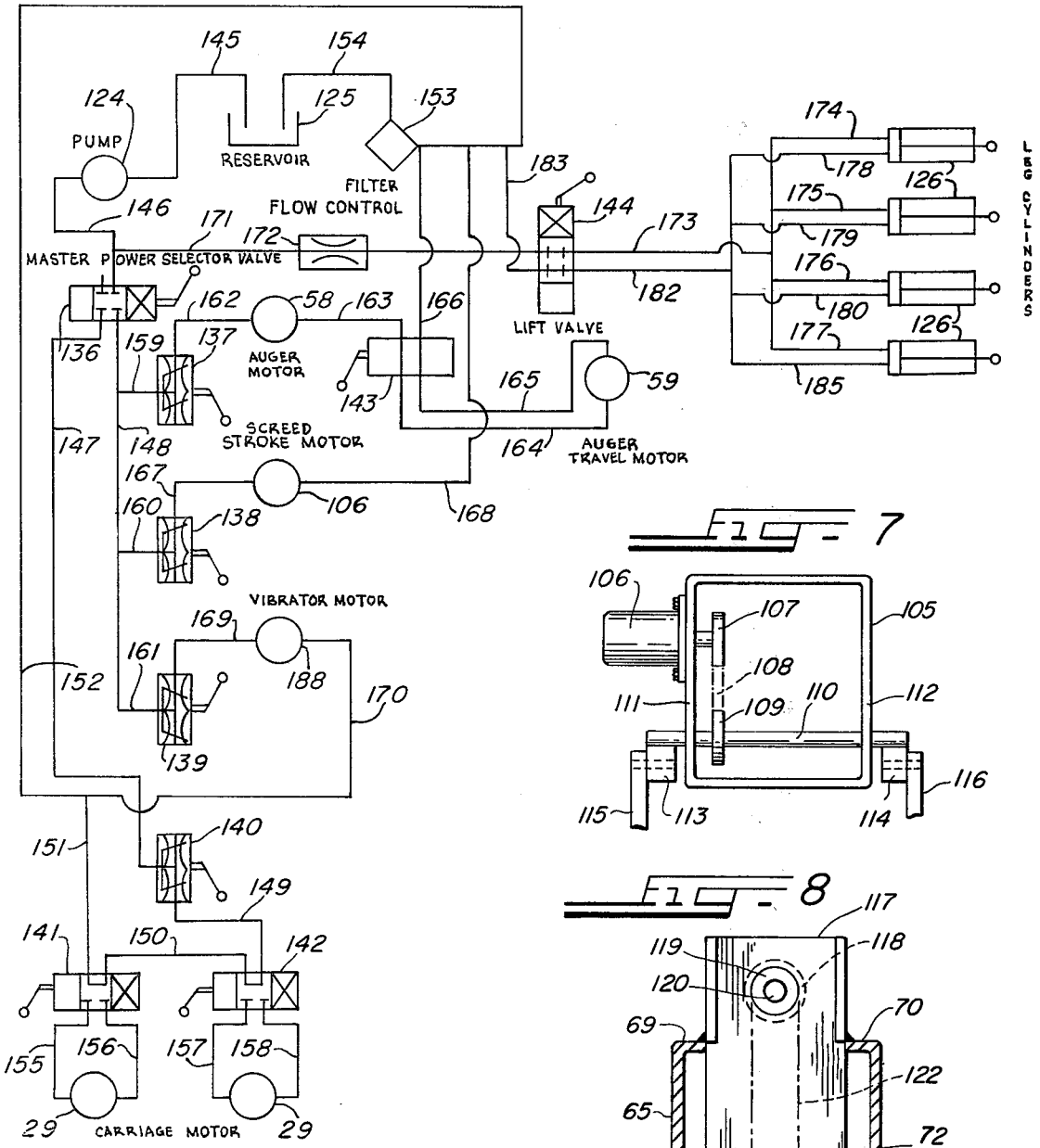
FIG. 7
FIG. 8
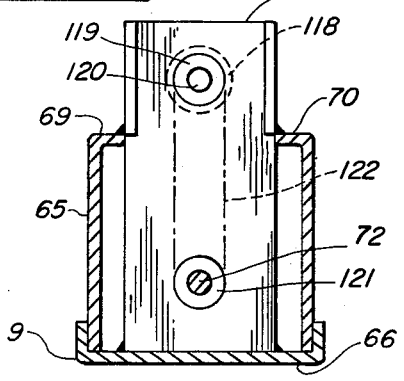

CONCRETE FINISHING MACHINES

BACKGROUND OF THE INVENTION

This invention relates to concrete finishing machines, and more particularly, to concrete finishing machines which are particularly well adapted for use on roadways, and the like.

It is a primary object of the present invention to afford a novel concrete finishing machine.

Concrete finishing machines of the general type to which the present invention pertains have been heretofore known known in the art, such as, for example, machines of the type shown in W. H. Lewis U.S. Pat. No. 2,583,108, issued Jan. 22, 1952, and C. Jackson U.S. Pat. No. 2,396,426, issued Mar. 12, 1946. It is an important object of the present invention to afford improvements over such machines heretofore in the art.

Another object of the present invention is to afford a novel concrete finishing machine which is particularly well adapted for use with low slump concrete.

A further object of the present invention is to afford a novel concrete finishing machine wherein the parts thereof are constituted and arranged in a novel and expeditious manner whereby concrete may be advanced along a roadway, or the like, and transversely spread across the roadway forwardly of the machine, with the initially spread concrete being thereafter smoothed by a concrete surfacing unit, which is effective to strike off, smooth and vibrate the concrete to the proper density and best quality finish.

Another object of the present invention is to afford a novel concrete finishing machine of the aforementioned type which embodies a screw conveyor or auger projecting forwardly in the direction of travel of the machine along the roadway, or the like, with an oscillating, vibrating elongated screed extending transversely to the movement of the machine along such a roadway, rearwardly of the auger, and operable to afford effective surfacing and vibration of the concrete over which the machine passes.

A further object of the present invention is to afford a novel concrete finishing machine which is practical and efficient in operation, and which may be readily and economically produced commercially.

Other and further objects of the present invention will be apparent from the following description and claims and are illustrated in the accompanying drawings, which, by way of illustration, show a preferred embodiment of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE DRAWINGS

In the drawings:

FIG. 7 is a detail sectional view taken substantially along the line 7—7 in FIG. 2;

FIG. 8 is a detail sectional view taken substantially along the line 8—8 in FIG. 2; and FIG. 9 is a schematic diagram of the hydraulic system of the machine shown in FIG. 1.

DESCRIPTION OF THE EMBODIMENT SHOWN HEREIN

Figure 1:
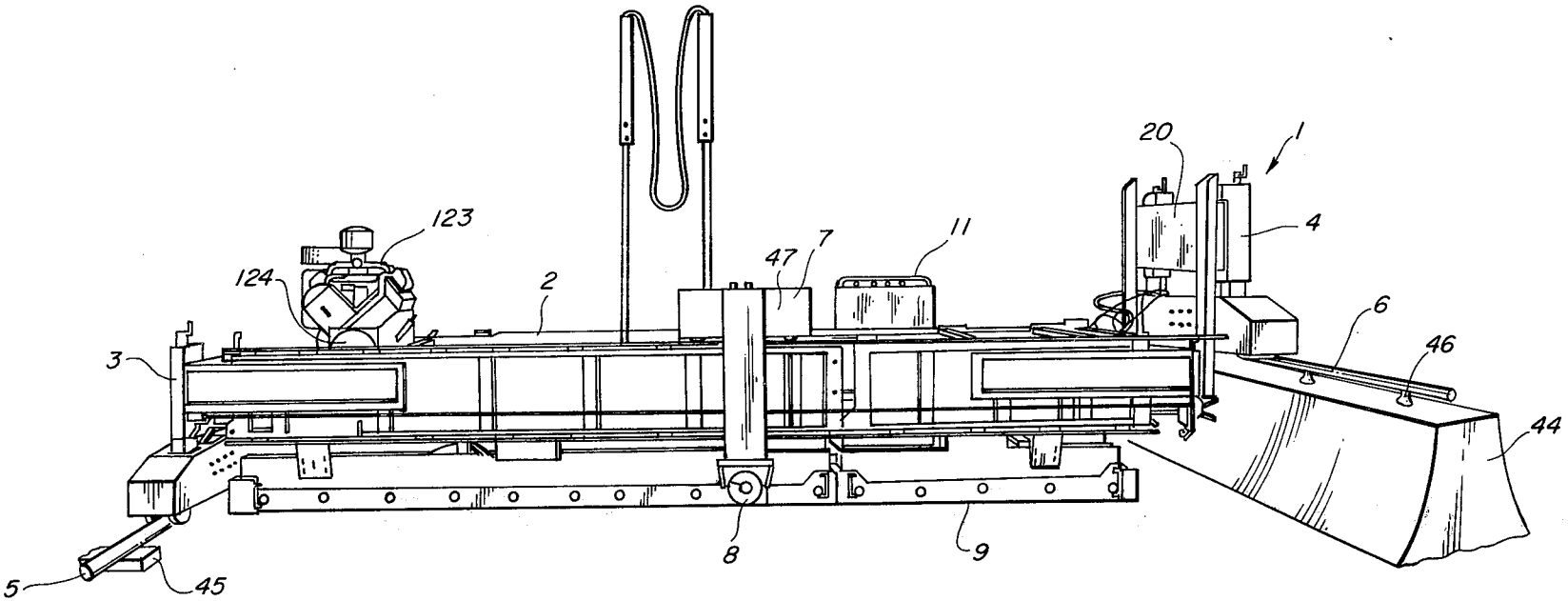
FIG. 1 is a front perspective view of a concrete finishing machine embodying the principles of the present invention.

A concrete finishing machine 1, embodying the principles of the present invention, is shown in the drawings to illustrate the presently preferred embodiment of the present invention.

The concrete finishing machine 1 embodies, in general, an elongated body or supporting frame 2, having carriages 3 and 4 disposed at opposite ends thereof for transporting the machine 1 longitudinally along a roadway or highway, or the like, along suitable supports, such as pipes or rails 5 and 6, FIG. 1, disposed at opposite sides of a road or highway surface, not shown, to be paved. The machine 1 is particularly well adapted for laying partial-depth concrete overlay on bridge decks, and the like, although, as will be appreciated by those skilled in the art, it may be used for other concrete-laying operations without departing from the purview of the broader aspects of the present invention.

Figure 2:
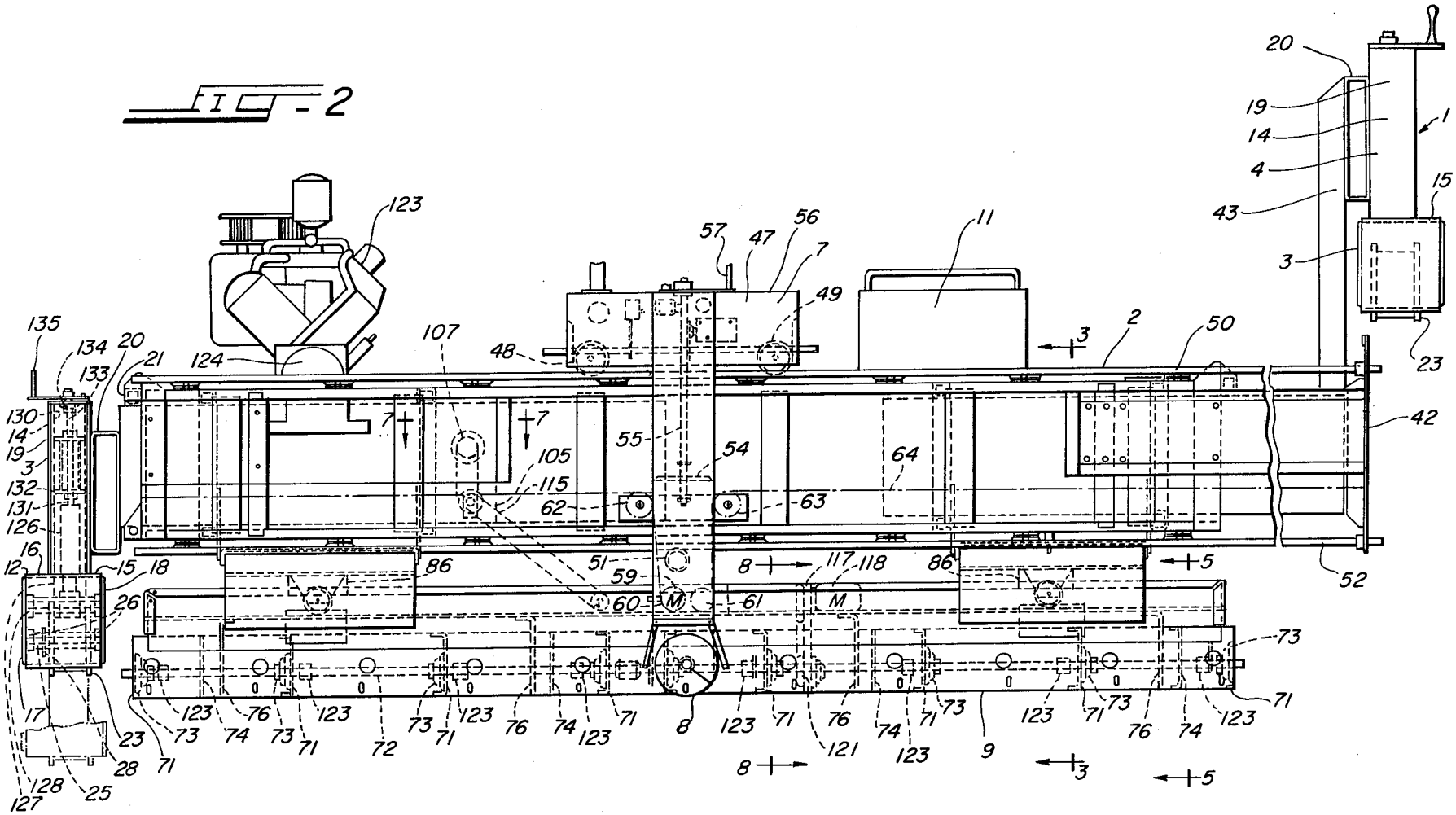
FIG. 2 is an enlarged, front elevational view of the machine shown in FIG. 1.
Figure 3:
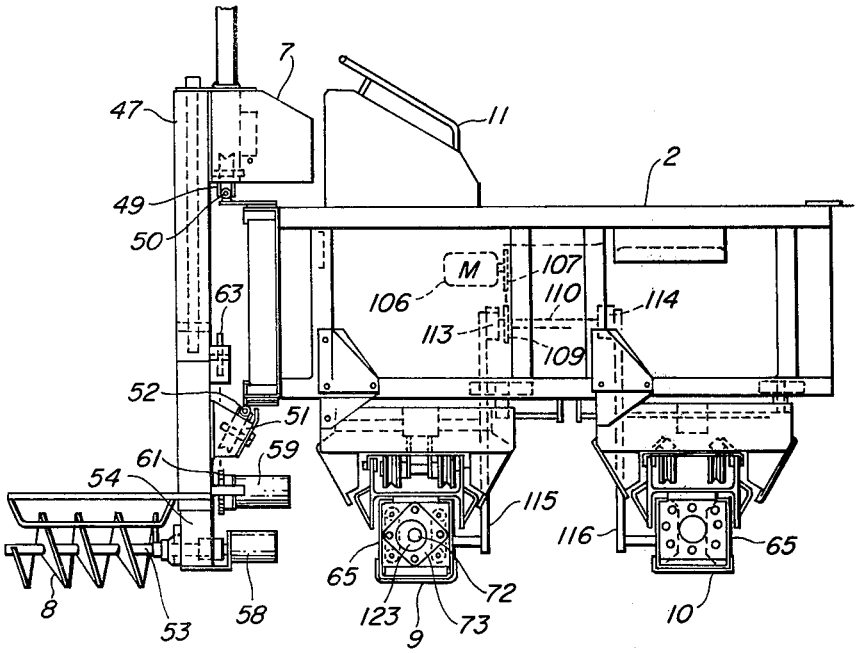
FIG. 3 is a transverse sectional view taken substantially along the line 3—3 in FIG. 2.

The machine 1 also embodies an auger unit 7, which includes a conveyor screw or auger 8 projecting forwardly from the lower end portion thereof, FIGS. 1-3. The auger unit 7 is mounted on the front side of the supporting frame 2, and is reciprocable longitudinally thereof for a purpose which will be discussed in greater detail presently.

The machine 1 also embodies two screeds 9 and 10, FIG. 3 mounted on and supported by the supporting frame 2 in depending relation thereto, the screeds 9 and 10 being disposed rearwardly of the auger 8 in spaced, substantially parallel relation to each other, and extending longitudinally of the frame 2 in substantially parallel relation thereto. A control console 11 is disposed on top of the supporting frame 2, at the front side thereof, and affords a station from which an operator, riding on the machine 1, may control the operation of the latter.

The carriage 3, which is disposed at the left end of the machine 1, as viewed in FIGS. 1 and 2, embodies an elongated, substantially horizontally extending base 12, from which two elongated legs 13 and 14 project upwardly from the respective opposite end portions thereof. The base 12 embodies an elongated housing 15, which is of substantially inverted U-shape in transverse cross section, FIG. 2, having a top wall 16, from the opposite longitudinal edges of which depend two side walls 17 and 18, respectively. The bottom of the housing 15 is open.

The legs 13 and 14 of the carriage 3 are identical in construction, and each embodies an elongated, tubular outer housing 19, which is substantially square in transverse cross section. The housings 19 are open at the bottom, and are disposed above the top wall 16 of the housing 15 in overlying, axial alignment with openings, not shown, in the housing 15. As will be discussed in greater detail presently, the base 12 is adjustably connected to the legs 13 and 14 for vertical movement relative to the latter.

A stiffening member 20, FIG. 1, extends between the legs 13 and 14, in upwardly spaced relation to the base portion 12, and is secured to the housing 19 of the leg portions 13 and 14 by suitable means, such as, for example, welding. The carriage 3 is secured to the end wall 21 of the supporting frame 2 by securing the stiffening member 20 to the end wall 21 in parallel relation thereto by suitable means, such as, for example, welding.

Two flanged wheels 22 and 23, which are identical in construction, are rotatably mounted in the rear and front ends, respectively, of the base portion 12 of the carriage 3. The wheels 22 and 23 are mounted on shafts 24 and 25, respectively, FIG. 4, which are journaled in suitable bearings 26 on the inner faces of the side walls 17 and 18 of the housing 15, as illustrated with respect to the wheel 23, in FIG. 2. The wheels 22 and 23 are secured to the respective axles or shafts 24 and 25 for rotation therewith, and sprocket wheels 27 and 28 are mounted on the axles 24 and 25 and secured thereto for a purpose which will be discussed in greater detail presently.

Figure 4:
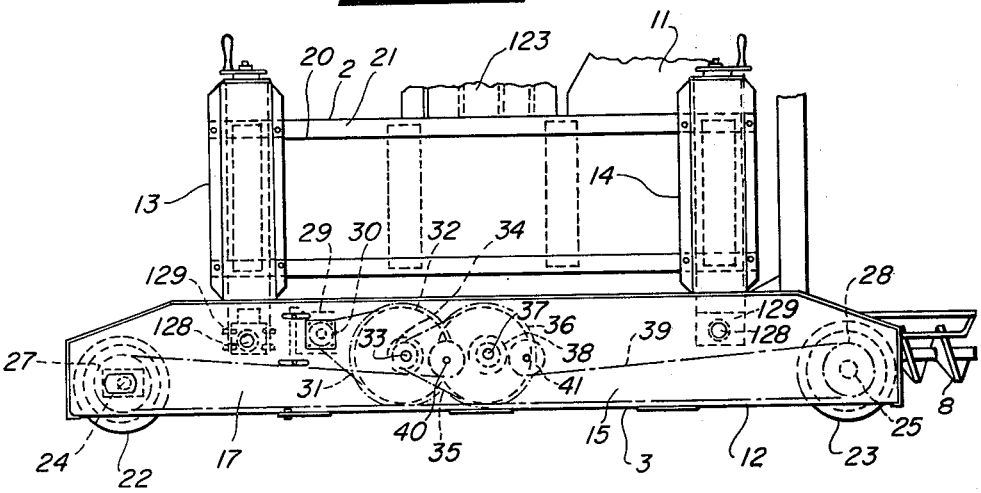
FIG. 4 is an end elevational view of the machine shown in FIG. 1.

A hydraulic motor 29 is mounted in the housing 15 of the carriage 3, FIG. 4, and is operatively connected to a sprocket wheel 30 for driving the latter. The sprocket wheel 30 is operatively connected by a sprocket chain 31 to a sprocket wheel 32, which is mounted on a shaft 33 for rotation with the latter. The shaft 33 is journaled in the housing 15, and another sprocket wheel 34 is secured thereto for rotation with the shaft 33 and the sprocket wheel 32. The sprocket wheel 34 is operatively connected by a chain 35 to a sprocket wheel 36, which is mounted on a shaft 37 journaled in the housing 15. Another sprocket wheel 38 is mounted on, and secured to the shaft 37 for rotation with the shaft 37 and the sprocket wheel 36. Rotation of the sprocket wheel 30 by the motor 29 is effective through the drive train afforded by the chains 31 and 35 and the sprocket wheels 32, 34 and 36, to rotate the shaft 37, and, therefore, the sprocket wheel 38. Another sprocket chain 39 extends around, and is operatively engaged with the sprocket wheels 27 and 28, with the upper pass, as viewed in FIG. 4, of the chain 39 disposed under two idler sprocket wheels 40 and 41 and over the sprocket wheel 38, to thereby operatively connect the sprocket wheels 27 an 28 and, therefore, the wheels 22 and 23, respectively, of the carriage 3 to the hydraulic motor 29. Thus, operation of the motor 29 is effective to rotate the wheels 22 and 23 and cause the carriage 3 to more forwardly or rearwardly, depending upon the operation of the motor 29.

The carriage 4 is identical in construction to the carriage 3 except that it is a mirror image thereof, and the parts thereof are indicated by the same reference numerals as applied to the corresponding parts of the carriage 3. In the machine 1, as shown in FIGS. 1 and 2, the carriage 4, instead of being mounted directly on the end wall 42 of the frame 2, which is remote from the end wall 21 thereof, is mounted on an extension 43, which projects upwardly from the frame 2 in position to dispose the carriage 4 at a higher elevation than the carriage 3. With this construction, the machine 1 is particularly well adapted for use on a highway, or a bridge, or the like, having a median pier or abutment, such as the median abutment 44 shown in FIG. 1. In such an operation, the supporting member 5 may be disposed on suitable supporting members 45, on the ground, and the supporting member 6 may be disposed on suitable supporting members 46 on top of the median abutment 44. Under such conditions, the wheels 22 and 23 of the carriage 3 may rest on the supporting member 5, and the wheels 22 and 23 of the carriage 4 may rest on the supporting member 6 for movement longitudinally thereof during movement of the machine 1 along the highway, or the like, being surfaced.

If desired, the extensions 43 may be eliminated from the machine 1, and the carriage 4 may be mounted directly on the end wall 42 of the frame 2 in the same manner that the carriage 3 is mounted on the end wall 21 of the frame 2, without departing from the purview of the broader aspects of the present invention, such construction affording a machine which would be supported on supporting members, which, like the track 5, are disposed at approximately ground level.

The auger unit 7 embodies an elongated housing 47, FIGS. 1 and 2, which has two flanged rollers 48 and 49 journaled in the upper end portion thereof, FIG. 2. The rollers 48 and 49 are supported on a track in the form of a rail or pipe 50 extending along the upper front edge portion of the supporting frame 2, FIGS. 2 and 3, to support the auger unit 7 for movement back and forth along the length of the supporting frame 2. Another roller 51 is journaled on the lower end portion of the housing 47, and the upper periphery of the roller 51 is engaged with a track in the form of a rail or pipe 52, which is disposed at the lower front edge of the frame 2 and extends the length thereof. It will be seen that with this construction, the auger unit 7 is held against downward and upward movement, respectively, relative to the frame 2 by the tracks 50 and 52.

The screw conveyor or auger 8 of the auger unit 7 is mounted on and secured to a shaft 53 for rotation therewith, FIG. 3. The shaft 53 is journaled in the lower end portion of a slide member 54, which is slidably mounted in the lower end portion of the housing 47 for upward and downward vertical movement relative thereto. An adjusting screw or feed screw 55 is threaded into the upper end portion of the slide 54, FIG. 2, and the upper end portion of the adjusting screw 55 is journaled in the top wall 56 of the housing 47. A crank 57 is connected to the upper end of the adjusting screw 55, and may be manually rotated to thereby turn the adjusting screw 55 and raise and lower the slide member 54 and the conveyor screw 8 carried thereby. A hydraulic motor 58 is mounted on the lower end portion of the slide member 54 in rearwardly projecting relation thereto, FIG. 3, and is operatively connected to the shaft 53 for drivingly rotating the conveyor screw 8.

Another hydraulic motor 59 is mounted on the lower end portion of the housing 47 of the auger unit 7 in rearwardly projecting relation thereto, FIG. 3, and is operatively connected to a sprocket wheel 60, which is disposed between the motor 59 and the housing 47, FIG. 2. Another sprocket wheel 61 is journaled on the rear of the lower end portion of the housing 47, in horizontally spaced, uniplanar relation to the sprocket wheel 60. Two other idler sprocket wheels 62 and 63 are mounted on the housing 47 and are disposed rearwardly thereof in upwardly spaced, uniplanar relation to the sprocket wheels 60 and 61. A sprocket chain 64, having its opposite ends secured to the end walls 21 and 42, respectively, of the supporting frame 2, extends from the end wall 21 downwardly around the sprocket wheel 62, under the sprocket wheels 60 and 61, and upwardly over the sprocket wheel 63 to the end wall 42 of the supporting frame 2. With this construction, operation of the hydraulic motor 59, and, therefore, the rotation of the sprocket wheel 60, is effective to drive the auger unit 7 along the sprocket chain 64 longitudinally of the front side of the supporting frame 2, the wheels 48 and 49 moving along the pipe rail 50 and the wheel 51 moving along the pipe rail 52 during such movement. The direction of movement of the auger unit 7 along the supporting frame 2 depends upon the direction of operation of the hydraulic motor 59, and, as will be discussed in greater detail presently, this may be controlled either manually or automatically by a reversing valve, which is actuated when the auger unit 7 reaches one end or the other of the supporting frame 2.

Figure 5:
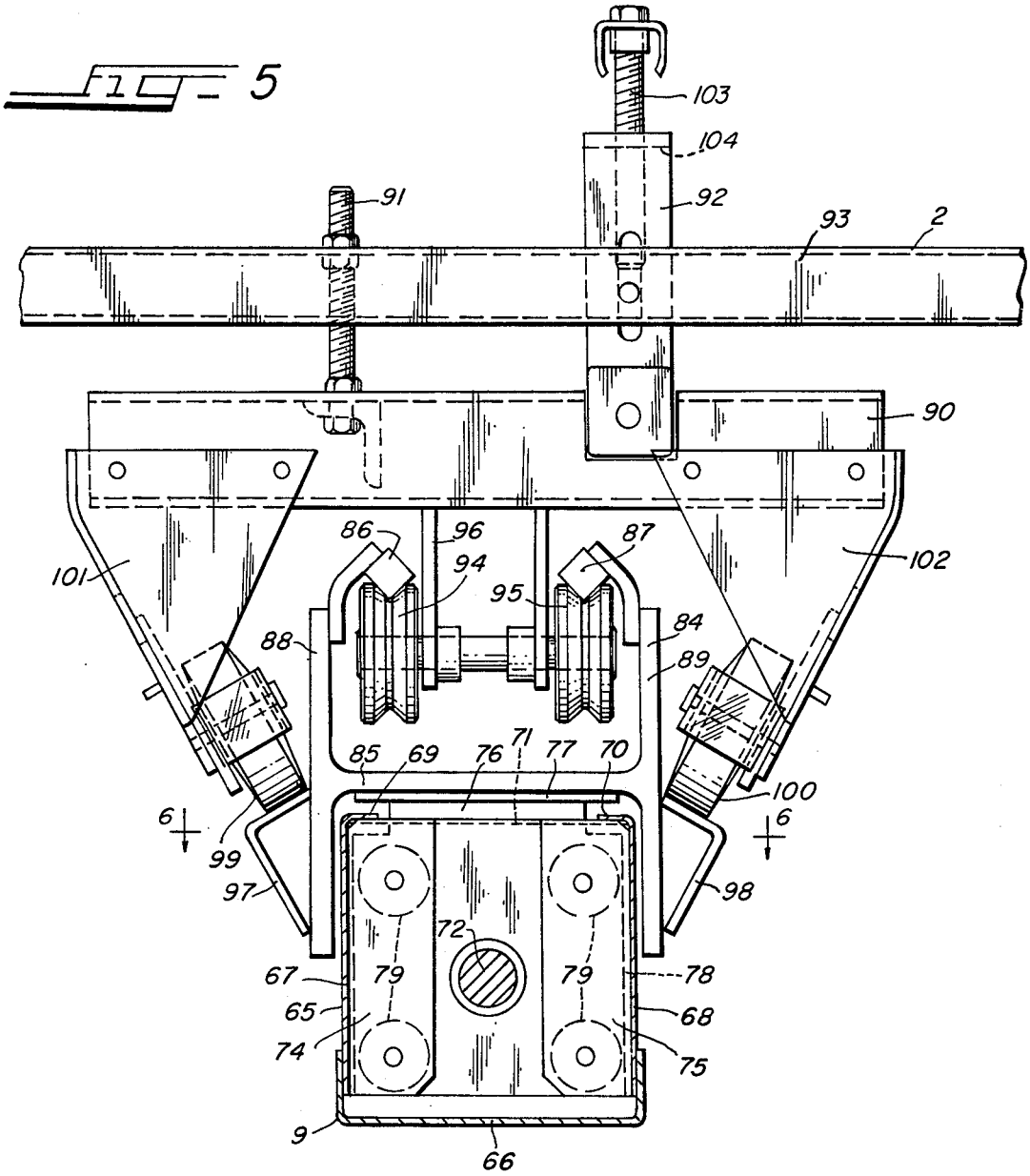
FIG. 5 is a detail sectional view taken substantially along the line 5—5 in FIG. 2.

Each of the screeds 9 and 10 embodies an elongated, open-topped, housing 65, FIGS. 3 and 5, which may be made of any suitable material, such as, for example, sheet steel. Each of the housings 65 embodies a bottom wall 66 mounted on and secured to two oppositely disposed, upright side walls 67 and 68, the side walls 67 and 68 preferably having relatively narrow, inwardly projecting strengthening flanges 69 and 70, respectively, at the upper edges thereof, FIG. 5. A plurality of reinforcing plates 71 are disposed in the housings 65 and are spaced from each other longitudinally thereof, FIG. 2. The reinforcing plates 71 extend transversely across each of the housing 65, and, preferably, are of such size that they completely fill the housings 65 in which they are mounted. They may be made of any suitable material, such as, for example, sheet steel, and may be secured to the respective housings 65 by any suitable means, such as, for example, welding. The reinforcing plates 71 have central openings, not shown, extending therethrough and an elongated shaft 72 extends through the openings, longitudinally of the housing 65 of the screed 9, and is journaled in suitable bearings 73 mounted on each of the respective reinforcing plates 71.

Each of the screeds 9 and 10 also embodies pairs of transversely spaced, uniplanar plates 74 and 75, FIG. 5, mounted in the housing 65 thereof and spaced from each other therealong, FIG. 2. The plates 74 and 75 in each of the pairs of plates are secured to the side walls 67 and 68, respectively, of the housings 65 by suitable means, such as, for example, welding.

In addition, each of the screeds 9 and 10 embodies a plurality of supporting plates 76, FIGS. 2 and 5, mounted in the respective housings 65. Each of the supporting plates 76 embodies a horizontally extending top flange 77 from which a body portion 78 depends, FIG. 5. The supporting plates 76 in the machine are of such size that the body portions 78 are disposed in the respective housings 65 in spaced relation thereto, and the flange 77 is disposed in upwardly spaced relation thereto.

Figure 6:
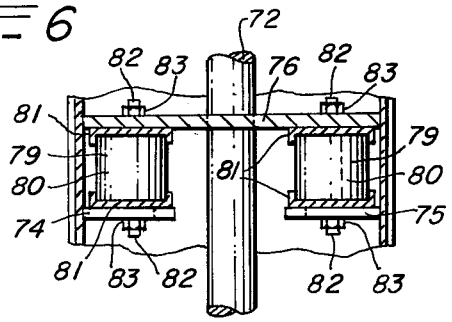
FIG. 6 is a detail sectional view taken substantially along the line 6—6 in FIG. 5.

Each of the supporting plates 76 is operatively connected to a respective one of the pairs of plates 74 and 75 by mounting or connecting members 79, FIGS. 5 and 6. The mounting members 79 are vibration-absorbing units embodying a central body portion 80 made of a suitable non-metallic, resilient material, such as, for example, hard rubber. Two end caps 81 are mounted on and secured to the opposite ends of the body portions 80. The end caps 81 may be made of any suitable material, such as, for example, steel and have bolts 82 projecting outwardly from the central portions of their faces. In mounting the mounting members 79 on the supporting plates 76 and pairs of plates 74 and 75, the bolts are inserted therethrough and secured in position by nuts 83, FIG. 6.

The housing 65 of each of the screeds 9 and 10 is disposed in the lower portion of a respective I-beam 84, which is disposed in position wherein the central web 85 thereof extends horizontally, FIGS. 3 and 5. Each of the I-beams 84 extend the full length of the respective housing 65, and the flanges 77 on the supporting plates 76 are secured to the webs 85 thereof by suitable means, such as, for example, welding, to dependingly support the housings 65 from the I-beams 84.

Two pairs of tracks 86 and 87 are mounted on the upper edge portions of the side flanges 88 and 89 of each of the I-beams 84, with the tracks 86 and 87 of each pair being in inwardly disposed position relative to the flanges 88 and 89 of the respective I-beams 84, as illustrated with respect to the screed 9, FIG. 5. The pairs of tracks 86 and 87 are disposed at respective end portions of the I-beams 84, as indicated by the tracks 86 shown in FIG. 2, and extend longitudinally of the I-beams 84 only a minor portion of the length of the latter, such as, for example, twelve inches.

Two supporting bars 90, one of which is shown in FIG. 5, is disposed above the longitudinal central portion of each of the pairs of tracks 86 and 87, and is secured by a bolt 91 and an adjusting bracket 92 to a tubular cross beam 93 on the bottom of the supporting frame 2. The supporting bars 90 extend transversely to the tracks 86 and 87, and two flanged rollers 94 and 95 are supported from each of the supporting bars 90 by a suitable hanger 96 in directly underlying supporting engagement with respective ones of the tracks 86 and 87. Thus, each of the screeds 9 and 10 is supported by two pairs of tracks 86 and 87 disposed at opposite end portions thereof, for limited longitudinal movement across the tops of the rollers 94 and 95, so that during operation of the machine 1, the screeds 9 and 10 may be oscillated longitudinally, as will be discussed in greater detail presently.

Two abutment members 97 and 98 are secured to the outer faces of the flanges 88 and 89 of each of the I-beams 84, in outwardly disposed, substantially parallel relation to each of the pairs of tracks 86 and 87. Two rollers 99 and 100 are supported by suitable hangers 101 and 102 from respective opposite ends of each of the supporting bars 90, as illustrated with respect to the screed 9 in FIG. 5, the rollers 99 and 100 being rotatable on the respective hangers 101 and 102, and being disposed in abutting engagement with the upper faces of the abutment members 97 and 98. With this construction, the screeds 9 and 10 are held against downward movement relative to the respective supporting bars 90, on which they are mounted, by the engagement of the pairs of tracks 86 and 87 with the pairs of rollers 94 and 95, and they are held against upward movement relative to the respective supporting bars 90 by the engagement of the pairs of rollers 99 and 100 with the respective pairs of abutment members 97 and 98. Thus, when the supporting bars 90 are firmly secured to the frame 2 of the machine 1, the screeds 9 and 10 are effectively held against accidental upward and downward movement relative to the frame 2.

The adjusting brackets 92, which are secured to end portions of respective supporting bars 90, each includes an adjusting screw 103 threaded through a top flange 104 on the respective bracket 92, and threaded into the top wall of the cross bar 93 of the frame 2. By rotating the bolts 103, the brackets 92 may be raised and lowered to thereby adjust the position of the supporting bars 90 and thereby adjust the transverse tilt of the screeds 9 and 10.

A housing 105, FIGS. 2 and 7, is mounted in a central portion of the supporting frame 2 of the machine 1, between and above the screeds 9 and 10. A hydraulic motor 106 is mounted on the outside of the housing 105 and is operatively connected to a drive sprocket 107 disposed in the housing 105. A sprocket chain 108 operatively connects the drive sprocket 107 to another sprocket wheel 109, which is mounted on and secured to a shaft 110, which extends across the housing 105 and is journaled in and extends outwardly of the side walls 111 and 112 thereof, FIG. 7.

Two crank arms 113 and 114 are mounted on the opposite end portions of the shaft 110 for rotation therewith, outwardly of the side walls 111 and 112, respectively, of the housing 105. Two connecting rods or pitmans 115 and 116 are pivotally connected at one end to the free ends of the crank arms 113 and 114, respectively, and the other ends of the pitmans 115 and 116 are pivotally connected to the flanges 89 and 88 of the I-beams 84, which are connected to the housings 65 of the screeds 9 and 10, respectively. With this construction, operation of the motor 106 is effective, through the sprocket wheel 107, the chain 108, the sprocket wheel 109 and the shaft 110 to rotate the crank arms 113 and 114 and thereby longitudinally oscillate the pitmans 115 and 116. Such oscillation of the pitmans 115 and 116 is operable, through the connection thereof to the I-beams 84 to longitudinally oscillate the screeds 9 and 10 on the rollers 94 and 95 in a straight-line motion, transversely to the length of the roadway or the like, across which the machine 1 extends. In the preferred embodiment of the machine 1, the effective length of the crank arms 113 and 114 is not substantially less than one and one-half inches and not substantially more than 2 and ½ inches, and, preferably, is in the nature of 2 inches. Thus, preferably, the overall length of stroke of each of the screeds 9 preferably is approximately 4 inches. Thus, the overall length of the rails 86 and 87 need not be very great to accommodate such movement of the screeds 9 and 10, and preferably is in the nature of the aforementioned twelve inches.

Another supporting plate 117, which may be made of any suitable material, such as, for example, three-eigths inch steel plate, or the like, is mounted in the housing 65 of the screed 9, FIGS. 2 and 8, in upwardly projecting relation thereto. The plate 117 is secured to the housing 65 by any suitable means, such as, for example, welding it to the flanges 69 and 70 and to the bottom wall 66.

Another hydraulic motor 118 is mounted in the upper end portion of the supporting plate 117 and has a sprocket wheel 119 mounted on and secured to the drive shaft 120 thereof. Another sprocket wheel 121 is mounted on and secured to the shaft 72, which it will be remembered extends longitudinally through the housing 65 of the screed 9, and the sprocket wheels 119 and 121 are operatively interconnected by a sprocket chain 122. Thus, operation of the hydraulic motor 118 is effective, through the sprocket wheels 119 and 120 and the chain 122 to rotate the shaft 72.

A plurality of weights 123, FIGS. 2 and 3, are eccentrically mounted on the shaft 72 in spaced relation to each other longitudinally of the latter. Thus, inasmuch as the shaft 72 is journaled in bearings 73 which are directly connected to the reinforcing plates 71, which are, in turn, directly connected to the housings 65 of the screed 9, rotation of the eccentric weights 123, during rotation of the shaft 72, is effective to cause vibration of the housing 65 of the screed 9. However, with the housing 65 of the screed 9 connected to the supporting plates 76 by the resilient mounting members 79, as previously described, the aforementioned vibration of the housing 65 of the screed 9 is effectively isolated from the supporting plates 76 and the remainder of the machine 1.

The machine 1 is self-propelling, and includes an engine 123, which may be of any suitable type, such as, for example, a diesel engine or a gasoline-driven engine, mounted in one end portion of the frame 2, FIGS. 1 and 2. A hydraulic pump 124, FIGS. 1, 2, and 9, is operatively connected to the drive shaft of the engine 123 for actuation thereby. The pump 124, which is connected to a suitable source of hydraulic fluid, such as a reservoir 125, FIG. 9, is operable to feed hydraulic fluid through each of the aforementioned hydraulic motors embodied in the machine 1, the controls for controlling the operation of the various hydraulic motors, and which will be discussed in greater detail hereinafter, preferably all being located at the console 11, behind which the operator of the machine 1 may be stationed.

In addition to the previously mentioned hydraulic motors, each of the carriages 3 and 4 embodies two hydraulic cylinders, such as the cylinder 126 shown in FIG. 2, each of the cylinders 126 being disposed in a respective one of the legs 13 and 14 of the carriages 3 and 4. Referring to FIG. 2, the lower end of the cylinder 126 in each of the legs is connected by a suitable hanger 127 to a shaft 128 which extends between and is secured to the side walls 17 and 18 of the respective base portion 12 by suitable bracket members 129, FIGS. 2 and 4. An internal housing 130, the outside size and shape of which is complimentary to the internal size and shape of the outer housing 19 of each of the legs 13 and 14 is slidably mounted in a respective one of the respective housings 19 and is secured to the underlying rod 128. The upper end of each internal housing 130 is open.

A piston 131 is disposed in each of the cylinders 126, and the upper end of each piston is welded to the bottom face of a guide member 132, which is slidably mounted in the respective inner housing 130. A feed screw or adjusting screw 133 is threaded into the upper end of the guide member 132, and, upon rotation, is effective to raise and lower the guide member 132 in the respective inner housing 130, to thereby raise and lower the piston 131 relative to the respective cylinder 126. The feed screw 133 extends upwardly through a suitable thrust bearing 134 at the top of the respective outer housing 19, and a crank 135 is secured to the upper end of the feed screw 133 for rotating the same.

In normal operation of the machine 1, the pistons 131 are bottomed in their respective cylinders 126, so that the wheels 23 and 24 are in an elevated position, relative to the legs 13 and 14, such as shown in solid lines in FIG. 2, the exact vertical position of the wheels 23 and 24 depending upon the adjustment which has been effected through actuation of the feed screw 133. However if during operation of the machine 1, it becomes desirable to raise the latter away from the roadway, or the like, such as, for example, if it is desired to reverse the machine and perform an additional smoothing operation on concrete, this may be readily accomplished, in a manner which will be discussed in greater detail presently, by feeding hydraulic fluid from the pump 124 into the cylinders 126 and thus causing the pistons 131, and, therefore, the legs 13 and 14 and the frame 2 to be moved upwardly relative to the base portions 12 of the carriages 3 and 4 as illustrated in broken lines with respect to the carriage 3 in FIG. 2.

Referring to the hydraulic flow diagram shown in FIG. 9, the preferred form of the machine 1 embodies a master power selector valve 136 for controlling the "on" and "off" condition of all of the hydraulic motors in the machine 1. It also embodies: a control valve 137 for controlling the operation of the auger drive motor 58; a control valve 138 for controlling the operation of the screed stroke motor 106; a control valve 139 for controlling the vibrator motor 118; a master control valve 140 and two individual control valves 141 and 142 for controlling the two carriage drive motors 29; a control valve 143 for controlling the auger-travel motor 59; and a control valve 144 for controlling the actuation of the leg cylinders 126.

In the machine 1, the pump 124 is connected to the reservoir 125 by an inlet line 145. The outlet of the pump 124 is connected by a line 146 to the inlet of the master power selector valve 136. Two outlet lines 147 and 148 extend from the valve 136.

The outlet line 147 is connected to the inlet of the master control valve 140 for the carriage motors 29, and the outlet of the valve 140 is connected by lines 149, 150 and 151 to the individual control valves 141 and 142 for the carriage motors 149 and to a return manifold 152, which is connected to the inlet side of a filter 153, the outlet side of which is connected by a line 154 to the reservoir 125. The valves 141 and 142 are connected by lines 155 and 156, and lines 157 and 158 to individual ones of the two carriage motors 29, respectively.

The other line 148 from the master power selector valve 136 is connected by lines 159, 160 and 161 to the inlet side of the control valves 137, 138 and 139, respectively. The outlet side of the control valve 137 is connected by a line 162 to the inlet side of the auger drive motor 58, the outlet side of which is connected by a line 163 to the inlet side of the control valve 143. The outlet side of the control valve 143 is connected by a line 164 to the inlet side of the auger travel motor 59, the outlet side of which is connected back through the control valve 143 by a line 165 and a line 166 to the return manifold 152.

The control valve 138, which is connected by the line 160 to the feed line 148, has its outlet side connected by a line 167 to the inlet side of the screed stroke motor 106, the outlet side of which is connected by a line 168 to the return manifold 152.

The control valve 139, which is connected to the feed line 148 by the line 161, has its outlet side connected by a line 169 to the inlet side of the vibrator motor 118, the outlet side of which is connected by a line 170 to the return manifold 152.

It will be seen that, with this construction, the master power selector valve 136 has the over-all control of all of the hydraulic motors in the machine 1, so that, in an emergency, the operation of the entire machine can be stopped by actuation of the valve 136.

In the operation of the machine 1, with the pump 124 being driven by the engine 123, and which the master power selector valve 136 open to the desired amount: the movement of the machine 1 along a highway or the like, on the wheels 22 and 23 of the carriages 3 and 4 may be controlled by the control valve 140, the operation of the wheels 22 and 23 on the individual carriages 3 and 4 being individually controlled by the valves 141 and 142, during turning of the machine 1, and the like; the control of both the auger-drive motor 58 and the auger-travel motor 59 may be controlled by the control valve 37, with the operation of the auger-drive motor 59 also being individually controlled by the control valve 143, which may be of any suitable type, such as, for example, a manually controlled valve or an automatic reversing valve, the auger-drive motor 59 being driven in either of two directions depending upon the actuated position of the control valve 143; the actuation of the screed-stroke motor 106 may be controlled by the control valve 138; and the operation of the vibrator motor 118 may be controlled by the control valve 139.

In the preferred form of the machine 1, as shown in FIG. 9, the control valve 134 for the leg cylinders 126 is not connected to the pump 124 through the master power selector valve 136, but is connected by a line 171 and a flow control valve 172 to the feed line 146 extending between the pump 124 and the control valve 136. The flow control valve 172 is of a type well known in the art for restricting the maximum flow of hydraulic fluid through the line 171 to a certain rate, such as for example, 6 gallons per minute. The outlet side of the control valve 144 is connected by a line 173 and individual lines 174, 175, 176, and 177 to respective ones of the four leg cylinders 126. The outlet side of the leg cylinders 126 are connected by individual lines 178, 179 and 180 and 181 and a line 182, from which the return flow from the line 182 is through the control valve 134 and a line 183 to the return manifold 152. With this construction, it will be seen that by actuation of the valve 144, the machine 1 may be raised and lowered on the wheels 23 and 24 of the carriages 3 and 4 by feeding hydraulic fluid into and exhausting hydraulic fluid from the cylinders 126, under the pistons 131, irrespective of whether the master power selector valve 136 is in "on" or "off" position.

In the operation of the machine 1 shown in the drawings, it may be moved to operative position on a roadway, or the like, with the conveyor screw 8 and the screeds 9 and 10 disposed in raised position, the lower portions of the carriages 3 and 4 being disposed in lowered position to effect such raising of the entire supporting frame 2, together with the conveyor screw and the screeds 9 and 10. The conveyor screw 8 and the screeds 9 and 10 may then be lowered into desired operative position by actuating the control valve 144 and thereby permitting the cylinders 126 to move upwardly into position wherein the pistons 131 therein are disposed in bottomed position relative thereto. The final adjustment of the desired height of the conveyor screw 8 over the roadway may be made by rotating the crank 57; and the final adjustment of the height of the screeds 9 and 10 over the roadway may be made by rotating the cranks 135 on each of the legs 13 and 14 of the carriages 3 and 4. Thereafter, concrete, which is to be spread, may be dumped on the roadway in front of the machine 1, and with the auger 8 being driven by the motor 58 and moved transversely across the roadway by the motor 59, the machine 1 may be driven forwardly into position to engage the auger 8 with the dumped concrete and thus spread the concrete transversely across the roadway, to a desired depth, the excess concrete being fed forwardly of the machine 1 by the auger 8. The machine 1 may then be driven further down the roadway, into position wherein the screeds 9 and 10 are moved into engagement with the concrete which has been previously spread by the auger 8, the oscillating and vibrating screed 9 being effective to smooth and float the concrete, as well as to compact the same. The speed of rotation of the auger 8 may be controlled by the control valve 139, and the speed of oscillation of the screed 9 may be controlled by the control valve 138, to thereby effectively control the density and the finish of the concrete being laid and smoothed by the machine 1.

In the drawings, the screed 10 is shown as not being of the vibrating type, the operation of the screed 10 in the preferred form of the machine 1 being in the nature of a finishing float member, which does not include the rotating shaft 72 and eccentric weights 123 of the screed 9. However, as will be appreciated by those skilled in the art, if desired, the screed 10 may be identically the same in construction as the screed 9, including embodying a vibrating mechanism therein, without departing from the purview of the broader aspects of the present invention.

If, during operation of the machine 1, it is found that concrete which has been operated upon has not been properly spread or smoothed, or the like, the frame 2, together with the conveyor screw 8 and the screeds 9 and 10 may be quickly and easily raised by actuating the control valve 144, which controls the leg cylinders 126, and the machine 1 may be reversely moved on the wheels 22 and 23 back into position to start another pass across the improperly spread or smoothed concrete, the frame 2, the conveyor screw 8 and the screeds 9 and 10 again being lowered into the desired operative position by actuating the control valve 144 and thus quickly lowering the pistons 131 into their normal operative position, wherein they are bottomed in the cylinders 126, and the machine 1 may then be again be actuated through a concrete spreading and smoothing operation.

From the foregoing it will be seen that the present invention affords a novel concrete finishing machine which is effective to spread and smooth concrete, which has been dumped in front of the machine, and to move excess concrete forwardly ahead of the machine.

In addition, it will be seen that the present invention affords a novel concrete finishing machine which embodies parts for forwardly feeding concrete; transversely spreading concrete; smoothing concrete and vibrating concrete, and which parts are constituted and arranged in a novel and expeditious manner.

Also, it will be seen that the present invention affords a novel concrete finishing machine which is practical and efficient in operation and which may be readily and economically produced commercially.

Thus, while I have illustrated and described the preferred embodiment of my invention, it is to be understood that this is capable of variation and modification and I therefore do not wish to be limited to the precise details set forth, but desire to avail myself of such changes and alterations as fall within the purview of the following claims.

I claim:

1. A concrete finishing machine comprising a. an elongated supporting frame, b. means mounted on said frame for moving said frame along a highway in a direction transverse to the length of said frame, c. supporting means mounted on said frame for movement longitudinally thereof, d. means mounted on said frame for reciprocating said supporting means longitudinally of said frame, e. an elongated conveyor screw 1. mounted on and carried by said supporting means for movement therewith longitudinally of said frame in a direction transverse to the length of said screw, and 2. projecting generally horizontally from one longitudinal side of said frame for moving concrete away from said one side upon rotation of said screw, f. means mounted on said supporting means for rotating said screw, g. an elongated screed, h. means mounting said screed on said frame in substantially directly underlying parallel relation thereto in position to engage concrete underlying said frame, i. means on said supporting frame for longitudinally reciprocating said screed, and j. means on said screed for vertically vibrating the latter, k. said means mounted said screed comprising 1. two pairs of substantially horizontally extending parallel tracks mounted on respective end portions of said screed and disposed thereabove in substantially parallel relation to said screed, 2. two pairs of rollers, 3. each of rollers supportingly underlying a respective end of said tracks, 4. abutment means projecting outwardly from opposite lateral sides of each of said end portions of said screed, and 5. two pairs or other rollers mounted on and supported by said frame in depending relation thereto, 6. each of said rollers being operatively engaged with the upper surface of a respective one of said abutment means in position to hold said tracks down against said first mentioned rollers.

2. A concrete finishing machine as defined in claim 1, and in which a. said screed comprises 1. an elongated housing of substantially U-shaped transverse cross-section and having a. a bottom wall and b. two side walls projecting upwardly from respective opposite longitudinal edges of said bottom wall, and 2. substantially upstanding supporting plates a. mounted in said housing in spaced relation to each other longitudinally of said housing, and b. secured to said side walls, b. said means mounting said screed comprises 1. other supporting plates a. mounted on and carried by said supporting frame in depending relation thereto, and b. being disposed in parallel spaced relation to respective ones of said first mentioned supporting plates, and 2. vibration-absorbing resilient connectors disposed between respective pairs of said adjacent ones of said first mentioned and other supporting plates in position to resiliently support said other plates from said first mentioned plates and isolate vibrations of said screed from said supporting frame.

3. A concrete finishing machine comprising a. an elongated supporting frame, b. means mounted on said frame for moving said frame along a highway in a direction transverse to the length of said frame, c. supporting means mounted on said frame for movement longitudinally thereof, d. means mounted on said frame for reciprocating said supporting means longitudinally of said frame, e. an elongated conveyor screw 1. mounted on and carried by said supporting means for movement therewith longitudinally of said frame in a direction transverse to the length of said screw, and 2. projecting generally horizontally from one longitudinal side of said frame, in the direction of movement of the latter along such a highway, for moving concrete away from said one side upon rotation of said screw, f. means mounted on said supporting means and operatively connected to said screw for rotating said screw, g. means operatively connected to said supporting means for moving said screw upwardly and downwardly relative to said frame, h. elongated screed means mounted on said frame in substantially directly underlying parallel relation thereto in position to engage concrete underlying said frame, i. means operatively connected to said screed means for raising and lowering the latter, j. means on said supporting frame and operatively connected to said screed means for longitudinally reciprocating said screed means, and k. means on said screed means for vertically vibrating the latter.

4. A concrete finishing machine as defined in claim 3, and in which a. said means for raising and lowering said screed means comprises means included in said first mentioned means for raising and lowering said frame and thereby simultaneously raising and lowering said conveyor screw and said screed means.

5. A concrete finishing machine as defined in claim 4, and a. which includes 1. a control station, 2. control means, at said control station, operatively connected to said first mentioned means for controlling movement of said frame along such a highway and selectively causing said frame to move in said one direction, move in the direction opposite to said one direction and to stop, and 3. other control means, at said control station, for controlling operation of said means for raising and lowering said frame.

6. A concrete finishing machine as defined in claim 4, and in which a. said means for vibrating said screed means comprises 1. an elongated shaft mounted in and extending longitudinally of said screed means, 2. means mounted on said supporting frame and operatively connected to said shaft for rotating said shaft, and 3. weight means eccentrically mounted on said shaft for rotation therewith.

7. A concrete finishing machine as defined in claim 4, and in which a. said screed means comprises two elongated screeds disposed in horizontally spaced, substantially parallel relation to each other in substantially directly underlying relation to said supporting frame, b. one of said screeds being closer than the other to said conveyor screw, and c. said means for vibrating comprises 1. an elongated shaft mounted in and extending longitudinally of said one screed, 2. means mounted on said supporting frame and operatively connected to said shaft for rotating said shaft, and 3. a plurality of weights eccentrically mounted on said shaft in spaced relation to each other for rotation with said shaft.

8. A concrete finishing machine as defined in claim 7, and in which a. said one screed is supported from said supporting frame by non-metallic resilient members for isolating vibrations of said one screed from said supporting frame.

9. A concrete finishing machine as defined in claim 5, and in which a. said supporting means comprises 1. one elongated substantially vertically extending supporting member mounted on said one side of said frame, 2. another elongated supporting member a. disposed in supporting engagement with said shaft, and b. movable upwardly and downwardly along said one supporting member, and 3. means operatively connected to said other supporting member for adjusting the vertical position of the latter relative to said one supporting member.

* * * * *

UNITED STATES PATENT OFFICE
CERTIFICATE OF CORRECTION

Patent No. 4,068,970 Dated January 17, 1978

Inventor(s) Murray A. Rowe

It is certified that error appears in the above-identified patent and that said Letters Patent are hereby corrected as shown below:

Column 1, line 18, after "heretofore" insert--known--;

Column 9, line 61, change "which" to--with--; and

Column 12, line 18, change "mounted" to--mounting--.

Signed and Sealed this

Thirtieth Day of May 1978

[SEAL]

Attest:

RUTH C. MASON
Attesting Officer

LUTRELLE F. PARKER
Acting Commissioner of Patents and Trademarks